US005550949A

United States Patent [19]

Takatori et al.

[11] Patent Number: 5,550,949

[45] Date of Patent: Aug. 27, 1996

[54] METHOD FOR COMPRESSING VOICE DATA BY DIVIDING EXTRACTED VOICE FREQUENCY DOMAIN PARAMETERS BY WEIGHTING VALUES

[75] Inventors: Sunao Takatori; Makoto Yamamoto, both of Tokyo, Japan

[73] Assignees: Yozan Inc., Tokyo; Sharp Corporation, Osaka, both of Japan

[21] Appl. No.: 172,172

[22] Filed: Dec. 23, 1993

[30] Foreign Application Priority Data

Dec. 25, 1992 [JP] Japan ..... 4-359004

[51] Int. Cl.[6] ..... G10L 3/02; G10L 9/00

[52] U.S. Cl. ..... 395/2.15; 395/2.14; 395/2.21

[58] Field of Search ..... 395/2, 2.21, 2.39, 395/2.36, 2.37, 2.14, 2.15, 2.1

[56] References Cited

U.S. PATENT DOCUMENTS

| | | | |
|---|---|---|---|
| 4,216,354 | 8/1980 | Esteban et al. | 175/15.55 |
| 4,633,490 | 12/1986 | Goertzel et al. | 375/122 |
| 4,727,354 | 2/1988 | Lindsay | 340/347 |
| 4,870,685 | 9/1989 | Kadokawa et al. | 381/31 |
| 4,905,297 | 2/1990 | Langdon, Jr. et al. | 382/56 |
| 4,935,882 | 6/1990 | Pennebaker et al. | 364/200 |
| 4,973,961 | 11/1990 | Chamzas et al. | 341/51 |

OTHER PUBLICATIONS

Voice compression compatibility and development issues Bindley, IEEE/Apr. 1990.

*Primary Examiner*—Allen R. MacDonald
*Assistant Examiner*—Richemond Dorvil
*Attorney, Agent, or Firm*—Cushman, Darby & Cushman

[57] ABSTRACT

A method is provided for effecting clear voice compression. Voice data is input over a predetermined time "T", and the time is divided into a plurality of time periods $t_0$ to $t_7$. Frequency components of a plurality of frequencies $f_0$ to $f_7$ are separated from the voice data for each time period $t_0$ to $t_7$, and frequency components $g_0$ to $g_7$ of a plurality of frequencies of change in each frequency component of the voice data are calculated. The voice data is then quantized by dividing the frequency components of change by weighting values, the weighting values for intermediate frequencies being lower than the weighting values used for other frequencies.

4 Claims, 3 Drawing Sheets

METHOD FOR COMPRESSING VOICE DATA BY DIVIDING EXTRACTED VOICE FREQUENCY DOMAIN PARAMETERS BY WEIGHTING VALUES

FIELD OF THE INVENTION

The present invention relates to a voice compression method.

BACKGROUND OF THE INVENTION

Conventionally, a method used for transferring voice by PCM (Pulse Code Modulation) has been well known; however, it has been difficult to perform clear and effective voice compression using such a method.

SUMMARY OF THE INVENTION

The present invention is provided to solve problems with conventional methods. An objective of the present invention is to provide a method capable of performing clear and effective voice compression.

In the voice compression method according to the present invention, voice data is transformed into the frequency domain, and extracted frequency components obtained from the transformation are analyzed in frequency so that frequency components of change in the frequency components are obtained. Then the latter components are divided by weighting values.

PREFERRED EMBODIMENT OF THE INVENTION

Hereinafter, an embodiment will be described of a voice compression method according to the present invention, referring to the attached drawings.

Figure 1:
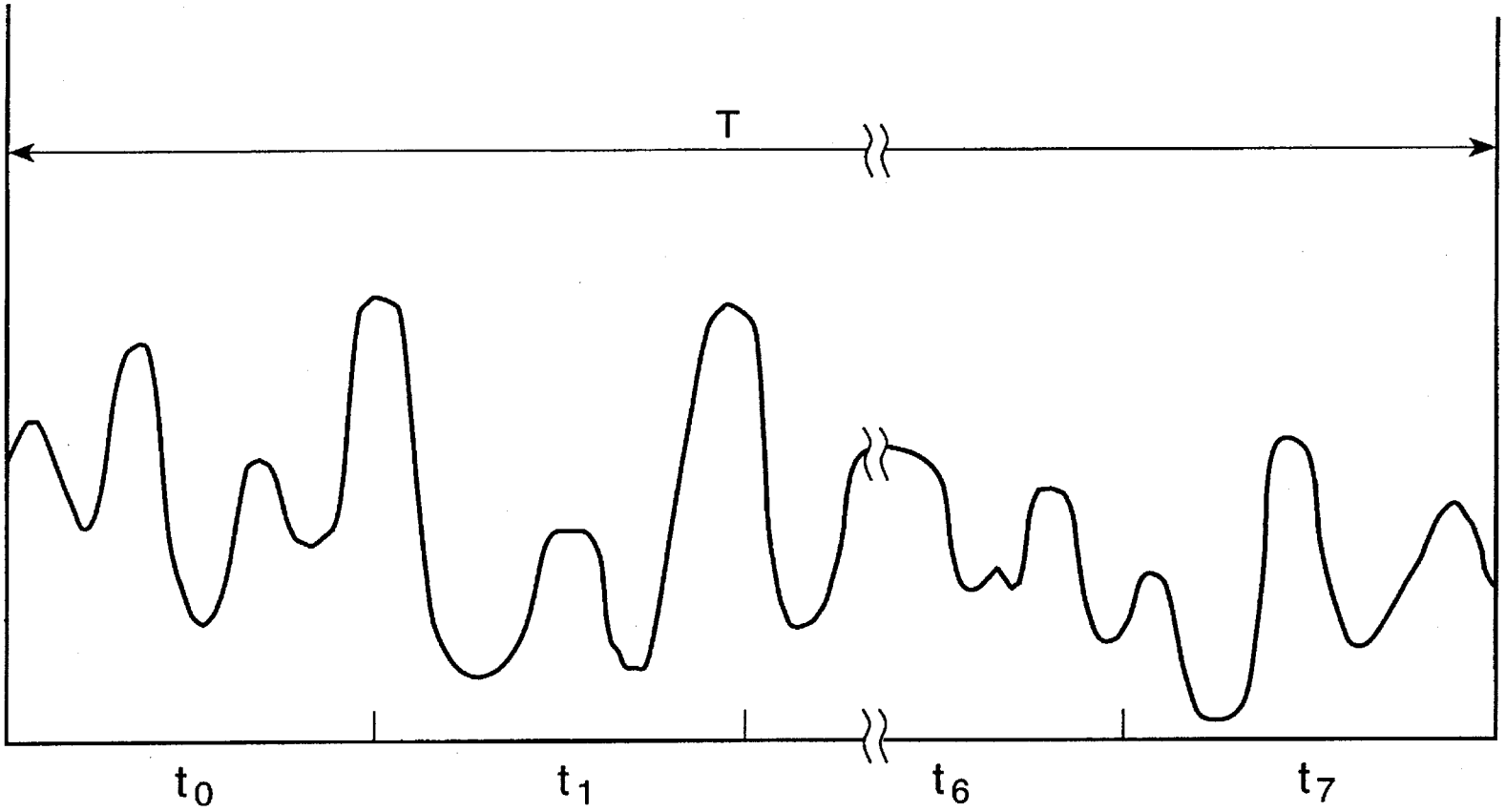
FIG. 1 is a conceptual diagram of a voice waveform input over a predetermined time T and divided by time periods ranging from $t_0$ to $t_7$.

First, voice data is input for a time "T". The time T may be divided into a plurality of time periods, for example 8 time periods $t_0$ to $t_7$ as shown in FIG. 1.

Next, frequency transformation is executed on the voice data in each time period $t_0$ to $t_7$. For example, frequency components of 8 specific frequencies from $f_0$ to $f_7$ are abstracted (selected/separated). In table 1, 64 frequency components $f_0(t_0)$ to $f_7(t_7)$ are shown.

Figure 2:
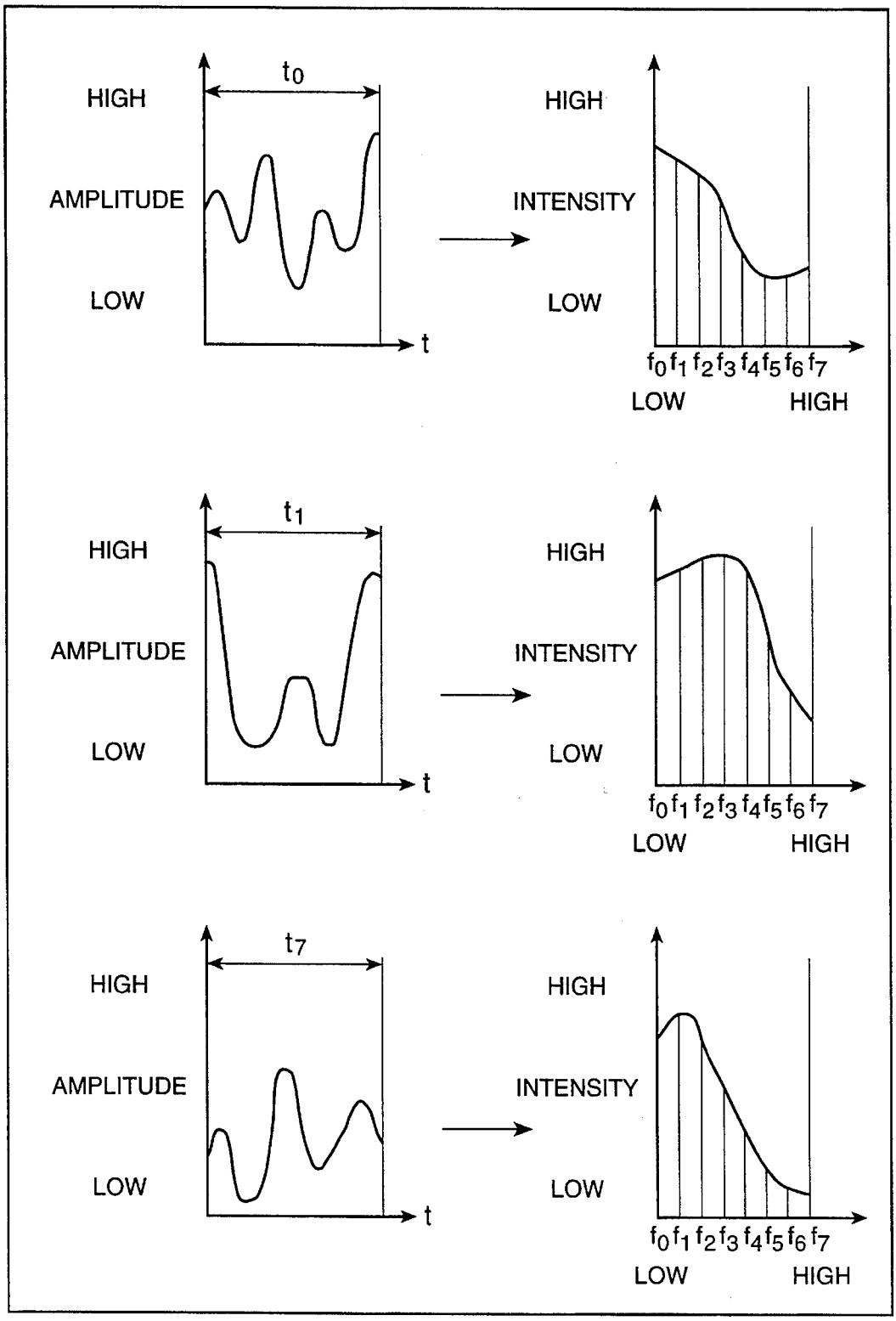
FIG. 2 is a conceptual diagram illustrating a frequency conversion of frequency of voice of time periods $t_0$, $t_1$ and $t_7$.

FIG. 2 is a conceptual diagrams showing extraction of frequency components from the voice data with respect to frequencies from $f_0$ to $f_7$ within time periods of $t_0$, $t_1$ and $t_7$. These frequencies correspond to shaded parts in Table 1. Frequencies $f_0$ to $f_7$ sequentially increased in value. The frequency values from $f_1$ to $f_7$ are obtained the frequency values by multiplying $f_0$ (the lowest) by integer numbers. The frequency values $f_0$ to $f_7$ are determined so that all of frequencies of human voice are involved in the range of these frequencies.

Next, performing frequency transformation of changes along time periods $t_0$ to $t_7$ in sequential frequency components from frequencies $f_0$ to $f_7$. For example, frequency components of 8 frequencies from $g_0$ to $g_7$ are extracted. In table 2, 64 frequency components $g_0(t_0)$ to $g_7(t_7)$ are shown.

Figure 3A:
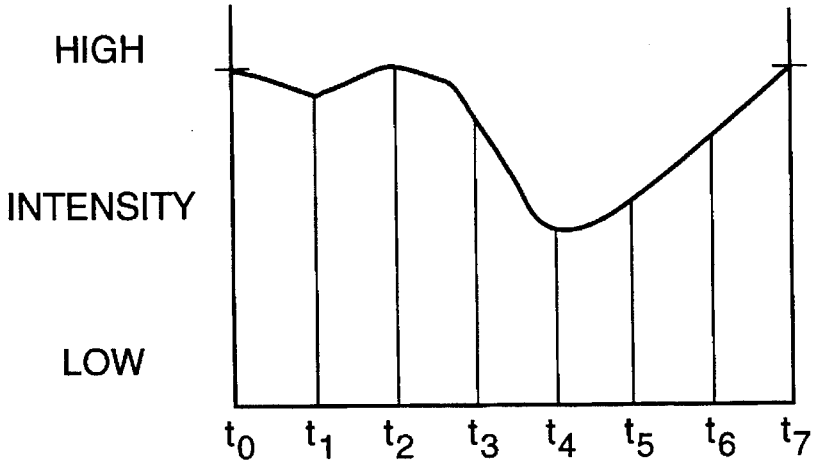
FIG. 3(*a*) is a conceptual diagram explaining a sequential change of frequency $f_0$, and FIG. 3(*b*) illustrates one frequency component abstracted (selected/separated), after the frequency conversion.
Figure 3B:
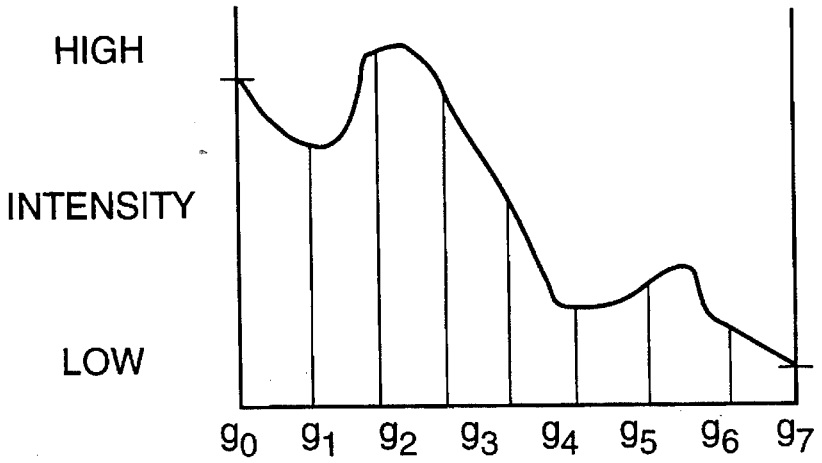

Table 2 shows frequency components of change along a vertical direction in table 1. FIG. 3(*a*) shows frequency components along time sequence of frequency $f_0$ surrounded by a thick line in table 1, that is, a change from $t_0$ to $t_7$ in table 1. FIG. 3(*b*) shows extraction frequency components of frequency changes from $g_0(f_0)$ to $g_7(f_0)$ with respect to 8 frequencies $g_0$ to $g_7$. Table 2 shows the part corresponding to these components surrounded by a thick line.

Frequencies $g_0$ to $g_7$ sequentially increase in their values, similarly to the frequencies $f_0$ to $f_7$. Frequencies $g_1$ to $g_7$ are frequency values obtained by multiplying the lowest frequency $g_0$ by an integer number.

As a result, 64 frequency components may be obtained representing changes of frequencies from a low range to high range included in a human voice in a two dimensional table such as that shown in Table 2.

The calculated 64 frequency components $g_0(f_0)$ to $g_7(f_7)$ are quantized according to a quantization table 3.

64 weighting values from $w_{01}$ to $w_{63}$ are given in the quantization table.

In table 3, a weighting value for frequency components largely involved in voice is set to a small value and a weighting value for frequency components less involved in voice is set a large value.

Each frequency component $g_0(f_0)$ to $g_7(f_7)$ is divided by a corresponding one of these weighting values. Then quantization of each frequency component in table 2 is performed.

Generally, most parts of the frequency component energy of human voice appear in an upper left table 2. In order to regenerate these frequency components in a receiving side, it is necessary to ensure extraction of these frequency components in table 2.

Weighting values corresponding to this region of the quantization table of "table 3" are made smaller than others. This region is shown with diagonal hatching in table 3.

That is, a denominator value used to divide these frequency components if smaller than denominator values used for other parts so that an absolutely large value is kept after quantization of these frequency components and extractions of these components is ensured.

On the other hand, the energy of frequency components in the middle region of table 2 is scarcely included in the human voice. So this energy is not important when voice is regenerated by a receiver. In order to delete or minimize these components, values of quantization table of "table 3" corresponding to the middle region are larger than those values in other parts. This region is shown with vertical lines in table 3.

It has been demonstrated that special voices such as an explosion sound have frequency component energy in the lower right part of table 2. Therefore, a value weighting of quantization table corresponding to these frequency components and sounds in a manner similar to the region designated by diagonal hatching are made small, in a manner and large quantized values are obtained so as to ensure extraction. Table 3 shows this region with dots.

As mentioned above, in the voice compression method according to the present invention, voice data is transformed in frequency and extracted frequency components obtained from the transformation are analyzed in frequency so that frequency components of change in the frequency components are obtained. Then the latter components are divided by weighting values and only necessary frequency components of the voice are transmitted, thus resulting in capable, clear and effective voice compression.

TABLE 1

| | | | | | | | |
|---|---|---|---|---|---|---|---|
| $f_0(t_0)$ | $f_1(t_0)$ | $f_2(t_0)$ | $f_3(t_0)$ | $f_4(t_0)$ | $f_5(t_0)$ | $f_6(t_0)$ | $f_7(t_0)$ |
| $f_0(t_1)$ | $f_1(t_1)$ | $f_2(t_1)$ | $f_3(t_1)$ | $f_4(t_1)$ | $f_5(t_1)$ | $f_6(t_1)$ | $f_7(t_1)$ |
| $f_0(t_2)$ | $f_1(t_2)$ | $f_2(t_2)$ | $f_3(t_2)$ | $f_4(t_2)$ | $f_5(t_2)$ | $f_6(t_2)$ | $f_7(t_2)$ |
| $f_0(t_3)$ | $f_1(t_3)$ | $f_2(t_3)$ | $f_3(t_3)$ | $f_4(t_3)$ | $f_5(t_3)$ | $f_6(t_3)$ | $f_7(t_3)$ |
| $f_0(t_4)$ | $f_1(t_4)$ | $f_2(t_4)$ | $f_3(t_4)$ | $f_4(t_4)$ | $f_5(t_4)$ | $f_6(t_4)$ | $f_7(t_4)$ |
| $f_0(t_5)$ | $f_1(t_5)$ | $f_2(t_5)$ | $f_3(t_5)$ | $f_4(t_5)$ | $f_5(t_5)$ | $f_6(t_5)$ | $f_7(t_5)$ |
| $f_0(t_6)$ | $f_1(t_6)$ | $f_2(t_6)$ | $f_3(t_6)$ | $f_4(t_6)$ | $f_5(t_6)$ | $f_6(t_6)$ | $f_7(t_6)$ |
| $f_0(t_7)$ | $f_1(t_7)$ | $f_2(t_7)$ | $f_3(t_7)$ | $f_4(t_7)$ | $f_5(t_7)$ | $f_6(t_7)$ | $f_7(t_7)$ |

TABLE 2

| | | | | | | | |
|---|---|---|---|---|---|---|---|
| $g_0(f_0)$ | $g_0(f_1)$ | $g_0(f_2)$ | $g_0(f_3)$ | $g_0(f_4)$ | $g_0(f_5)$ | $g_0(f_6)$ | $g_0(f_7)$ |
| $g_1(f_0)$ | $g_1(t_1)$ | $g_1(f_2)$ | $g_1(f_3)$ | $g_1(f_4)$ | $g_1(f_5)$ | $g_1(f_6)$ | $g_1(f_7)$ |
| $g_2(f_0)$ | $g_2(f_1)$ | $g_2(f_2)$ | $g_2(f_3)$ | $g_2(f_4)$ | $g_2(f_5)$ | $g_2(f_6)$ | $g_2(f_7)$ |
| $g_3(f_0)$ | $g_3(f_1)$ | $g_3(f_2)$ | $g_3(f_3)$ | $g_3(f_4)$ | $g_3(f_5)$ | $g_3(f_6)$ | $g_3(f_7)$ |
| $g_4(f_0)$ | $g_4(f_1)$ | $g_4(f_2)$ | $g_4(f_3)$ | $g_4(f_4)$ | $g_4(f_5)$ | $g_4(f_6)$ | $g_4(f_7)$ |
| $g_5(f_0)$ | $g_6(f_1)$ | $g_5(f_2)$ | $g_5(f_3)$ | $g_5(f_4)$ | $g_5(f_5)$ | $g_5(f_6)$ | $g_5(f_7)$ |
| $g_6(f_0)$ | $g_6(f_1)$ | $g_6(f_2)$ | $g_6(f_3)$ | $g_6(f_4)$ | $g_6(f_5)$ | $g_6(f_6)$ | $g_6(f_7)$ |
| $g_7(f_0)$ | $g_7(f_1)$ | $g_7(f_2)$ | $g_7(f_3)$ | $g_7(f_4)$ | $g_7(f_5)$ | $g_7(f_6)$ | $g_7(f_7)$ |

TABLE 3

| Quantized Table | | | | | | | |
|---|---|---|---|---|---|---|---|
| W00 | W01 | W02 | W03 | W04 | W05 | W06 | W07 |
| W08 | W09 | W10 | W11 | W12 | W13 | W14 | W15 |
| W16 | W17 | W18 | W19 | W20 | W21 | W22 | W23 |
| W24 | W25 | W26 | W27 | W28 | W29 | W30 | W31 |
| W32 | W33 | W34 | W35 | W36 | W37 | W38 | W39 |
| W40 | W41 | W42 | W43 | W44 | W45 | W46 | W47 |
| W48 | W49 | W50 | W51 | W52 | W53 | W54 | W55 |
| W56 | W57 | W58 | W59 | W60 | W61 | W62 | W63 |

TABLE 4

| | | | | | | | |
|---|---|---|---|---|---|---|---|
| $g_0(f_0)$ / W00 | $g_0(f_1)$ / W01 | $g_0(f_2)$ / W02 | $g_0(f_3)$ / W03 | $g_0(f_4)$ / W04 | $g_0(f_5)$ / W05 | $g_0(f_6)$ / W06 | $g_0(f_7)$ / W07 |
| $g_1(f_0)$ / W08 | $g_1(f_1)$ / W09 | $g_1(f_2)$ / W10 | $g_1(f_3)$ / W11 | $g_1(f_4)$ / W12 | $g_1(f_5)$ / W13 | $g_1(f_6)$ / W14 | $g_1(f_7)$ / W15 |
| $g_2(f_0)$ / W16 | $g_2(f_1)$ / W17 | $g_2(f_2)$ / W18 | $g_2(f_3)$ / W19 | $g_2(f_4)$ / W20 | $g_2(f_5)$ / W21 | $g_2(f_6)$ / W22 | $g_2(f_7)$ / W23 |
| $g_3(f_0)$ / W24 | $g_3(f_1)$ / W25 | $g_3(f_2)$ / W26 | $g_3(f_3)$ / W27 | $g_3(f_4)$ / W28 | $g_3(f_5)$ / W29 | $g_3(f_6)$ / W30 | $g_3(f_7)$ / W31 |
| $g_4(f_0)$ / W32 | $g_4(f_1)$ / W33 | $g_4(f_2)$ / W34 | $g_4(f_3)$ / W35 | $g_4(f_4)$ / W36 | $g_4(f_5)$ / W37 | $g_4(f_6)$ / W38 | $g_4(f_7)$ / W39 |
| $g_5(f_0)$ / W40 | $g_5(f_1)$ / W41 | $g_5(f_2)$ / W42 | $g_5(f_3)$ / W43 | $g_5(f_4)$ / W44 | $g_5(f_5)$ / W45 | $g_5(f_6)$ / W46 | $g_5(f_7)$ / W47 |
| $g_6(f_0)$ / W48 | $g_6(f_1)$ / W49 | $g_6(f_2)$ / W50 | $g_6(f_3)$ / W51 | $g_6(f_4)$ / W52 | $g_6(f_5)$ / W53 | $g_6(f_6)$ / W54 | $g_6(f_7)$ / W55 |
| $g_7(f_0)$ / W56 | $g_7(f_1)$ / W57 | $g_7(f_2)$ / W58 | $g_7(f_3)$ / W59 | $g_7(f_4)$ / W60 | $g_7(f_5)$ / W61 | $g_7(f_6)$ / W62 | $g_7(f_7)$ / W63 |

What is claimed is:

1. A voice compression method comprising steps of:

(a) inputting voice data for a predetermined time;

(b) dividing said predetermined time into a plurality of time periods;

(c) separating sets of initial frequency components from said voice data, each said set of initial frequency component corresponding to one of said plurality of time periods and having plural frequency components corresponding to respective ones of a plurality of initial frequencies;

(d) calculating sets of further frequency components, each of said sets of further frequency components corresponding to one of said plurality of frequency components and the corresponding one of said initial frequencies and including information representing a frequency transformation performed on said one of said plural of frequency components; and (e) quantizing said voice data, said quantizing step including dividing said further frequency components by corresponding weighting values, certain ones of said weighting values that correspond to selected ones of said further frequency components at intermediate frequencies being lower than other ones of said weighting values that correspond to other ones of said further frequencies components.

2. A voice compression method as claimed in claim 1, wherein the frequencies of each of said initial frequency components are frequency values obtained by multiplying a lowest frequency value by an integer.

3. A voice compression method as claimed in claim 2, wherein the frequencies of each of said further frequency components are frequency values obtained by multiplying a lowest frequency value by an integer.

4. A voice compression method as claimed in claim 1, wherein said step of calculating comprises calculating said further frequency components from said voice data.

* * * * *